US006702690B1

(12) United States Patent
Albright

(10) Patent No.: US 6,702,690 B1
(45) Date of Patent: Mar. 9, 2004

(54) GOLF PUTTING TRAINER DEVICE

(76) Inventor: Darrell T. Albright, 2541 Green Valley Blvd., Burlington, NC (US) 27320

( * ) Notice: Subject to any disclaimer, the term of this patent is extended or adjusted under 35 U.S.C. 154(b) by 0 days.

(21) Appl. No.: 10/370,218

(22) Filed: Feb. 21, 2003

(51) Int. Cl.[7] ..... A63B 69/36

(52) U.S. Cl. ..... 473/265; 473/219; 473/220; 473/221; 473/257

(58) Field of Search ..... 473/266, 219, 473/220, 221, 222, 224, 225, 257, 261, 265

(56) References Cited

U.S. PATENT DOCUMENTS

| | | | | | |
|---|---|---|---|---|---|
| 3,009,704 | A | | 11/1961 | Heard | |
| 3,194,563 | A | | 7/1965 | Mackniesh | |
| 3,194,565 | A | * | 7/1965 | Schroer | 473/265 |
| 3,572,720 | A | * | 3/1971 | Berg | 473/159 |
| 3,685,833 | A | | 8/1972 | Jack, Jr. | |
| 3,894,739 | A | * | 7/1975 | Goldstein | 473/225 |
| 4,155,555 | A | * | 5/1979 | Fink | 473/221 |
| 4,251,077 | A | * | 2/1981 | Pelz et al. | 473/222 |
| 4,620,708 | A | * | 11/1986 | Meyer et al. | 473/265 |
| 5,452,897 | A | | 9/1995 | Mick | |
| 5,527,041 | A | | 6/1996 | Terry, III et al. | |
| D385,007 | S | | 10/1997 | Perrin | |
| 6,036,608 | A | * | 3/2000 | Morris | 473/220 |
| 6,159,106 | A | * | 12/2000 | Adams | 473/265 |
| 6,227,984 | B1 | * | 5/2001 | Blankenship | 473/221 |
| 6,461,247 | B1 | * | 10/2002 | Riddell | 473/219 |

* cited by examiner

*Primary Examiner*—Raleigh W. Chiu

(57) ABSTRACT

A golf putting trainer device for practicing one's putting stroke. The golf putting trainer device includes a mat assembly including an elongate mat having a top surface; and also includes a putter miss-stroke determination assembly including housing members being disposed upon the top surface of the elongate mat, and also including light beam-emitting members being disposed in the housing members, and further including light sensor members being disposed upon the top surface of the elongate mat; and also includes a putter miss-stroke signal assembly including a sound-producing member being disposed in the elongate mat and being connected to the light sensor members and being connected to a power cord for the energizing thereof, and also including a light-emitting member being disposed in the elongate mat and being connected to the light sensor members and to the power cord.

8 Claims, 5 Drawing Sheets

GOLF PUTTING TRAINER DEVICE

BACKGROUND OF THE INVENTION

1. Field of the Invention

The present invention relates to golf putting trainers and more particularly pertains to a new golf putting trainer device for practicing one's putting stroke.

2. Description of the Prior Art

The use of golf putting trainers is known in the prior art. More specifically, golf putting trainers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,009,704; 3,685,833; 3,194,563; 5,527,041; 5,452,897; and U.S. Pat. No. Des. 385,007.

While these devices fulfill their respective, particular objectives and requirements, the aforementioned patents do not disclose a new golf putting trainer device. The prior art includes golf mats but none with adjustable positioning light beam-emitting members.

SUMMARY OF THE INVENTION

The general practicing one's putting stroke of the present invention, which will be described subsequently in greater detail, is to provide a new golf putting trainer device which has many of the advantages of the golf putting trainers mentioned heretofore and many novel features that result in a new golf putting trainer device which is not anticipated, rendered obvious, suggested, or even implied by any of the prior art golf putting trainers, either alone or in any combination thereof. The present invention includes a mat assembly including an elongate mat having a top surface; and also includes a putter miss-stroke determination assembly including housing members being disposed upon the top surface of the elongate mat, and also including light beam-emitting members being disposed in the housing members, and further including light sensor members being disposed upon the top surface of the elongate mat; and also includes a putter miss-stroke signal assembly including a sound-producing member being disposed in the elongate mat and being connected to the light sensor members and being connected to a power cord for the energizing thereof, and also including a light-emitting member being disposed in the elongate mat and being connected to the light sensor members and to the power cord. None of the prior art includes the combination of the elements of the present invention.

There has thus been outlined, rather broadly, the more important features of the golf putting trainer device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the practicing one's putting stroke of description and should not be regarded as limiting.

It is an object of the present invention to provide a new golf putting trainer device which has many of the advantages of the golf putting trainers mentioned heretofore and many novel features that result in a new golf putting trainer device which is not anticipated, rendered obvious, suggested, or even implied by any of the prior art golf putting trainers, either alone or in any combination thereof.

Still another object of the present invention is to provide a new golf putting trainer device for practicing one's putting stroke.

Still yet another object of the present invention is to provide a new golf putting trainer device that teaches the user to move the putter in a straight line resulting in muscle memorization and for putting the golf ball straight and true.

Even still another object of the present invention is to provide a new golf putting trainer device that is easy and convenient to set up and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
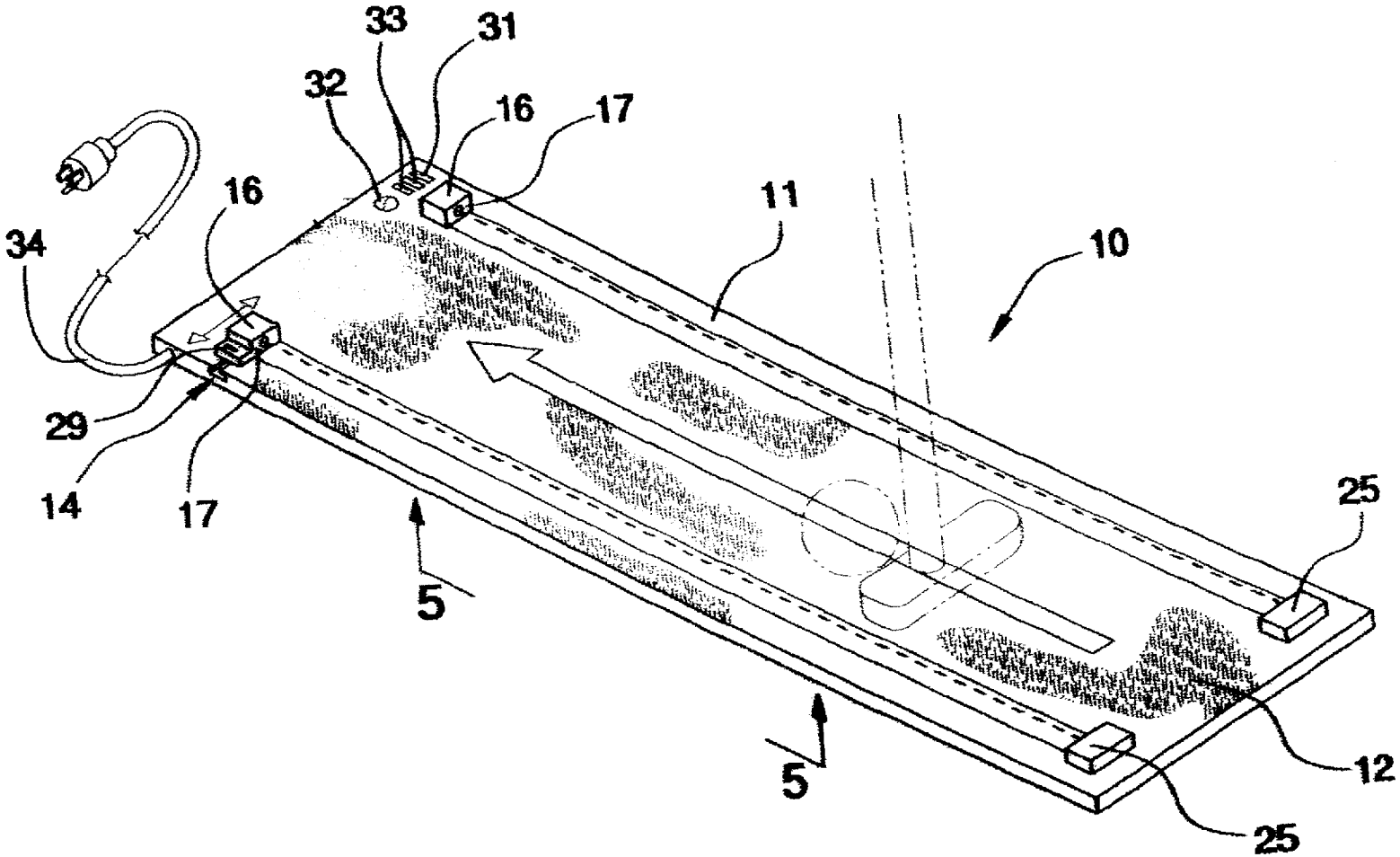
FIG. 1 is a top perspective view of a new golf putting trainer device according to the present invention.
Figure 2:
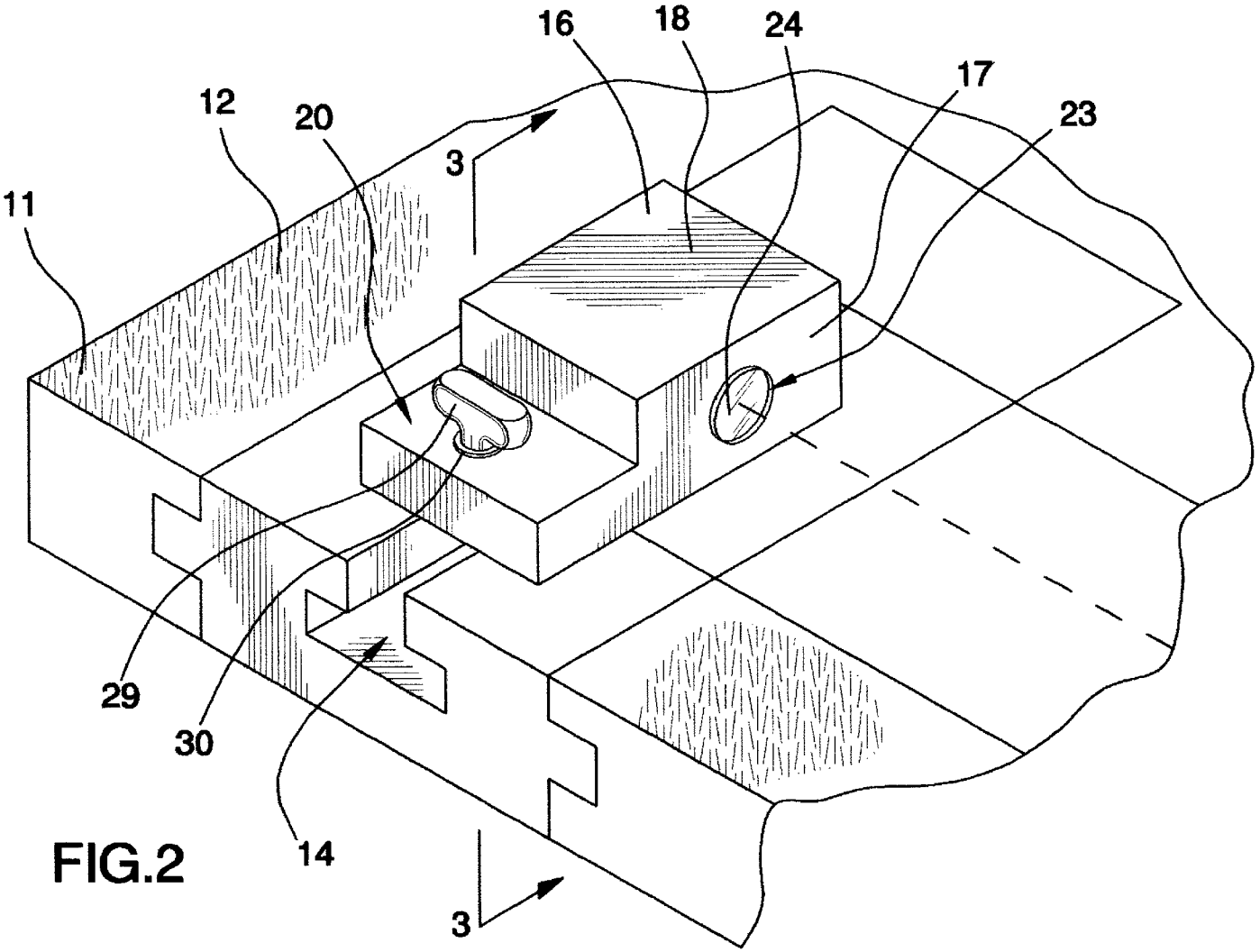
FIG. 2 is a detailed partial perspective view of the present invention.
Figure 3:
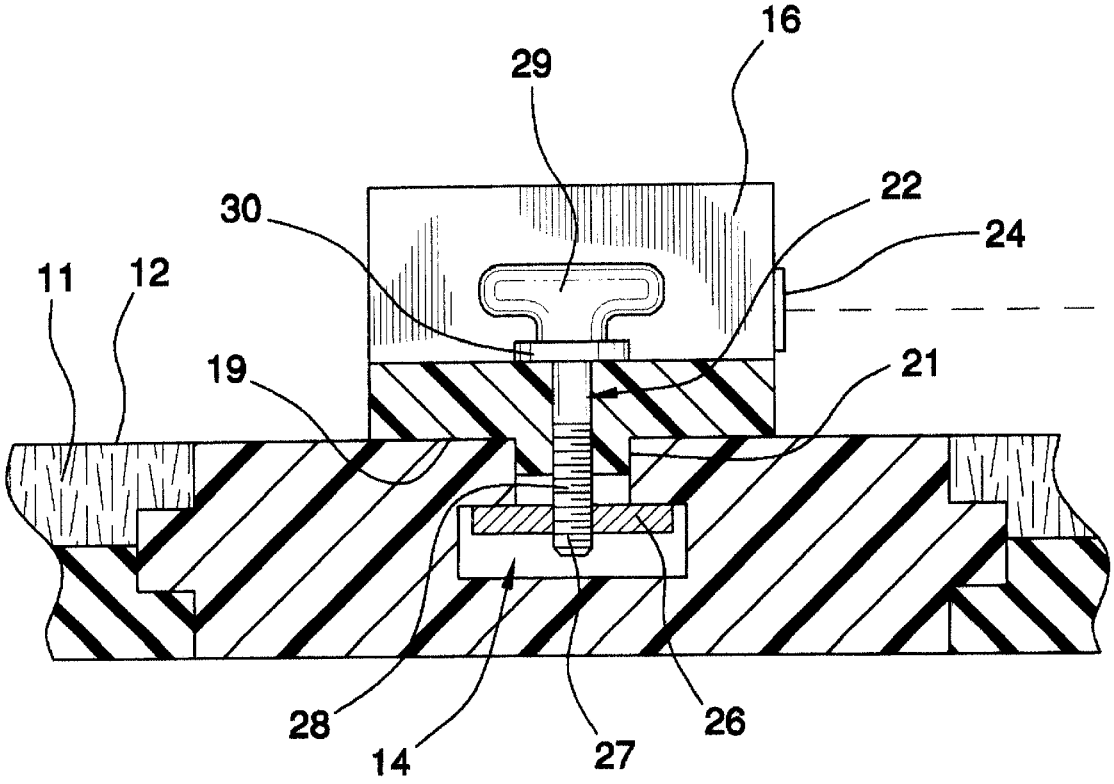
FIG. 3 is a detailed partial cross-sectional view of the present invention.
Figure 4:
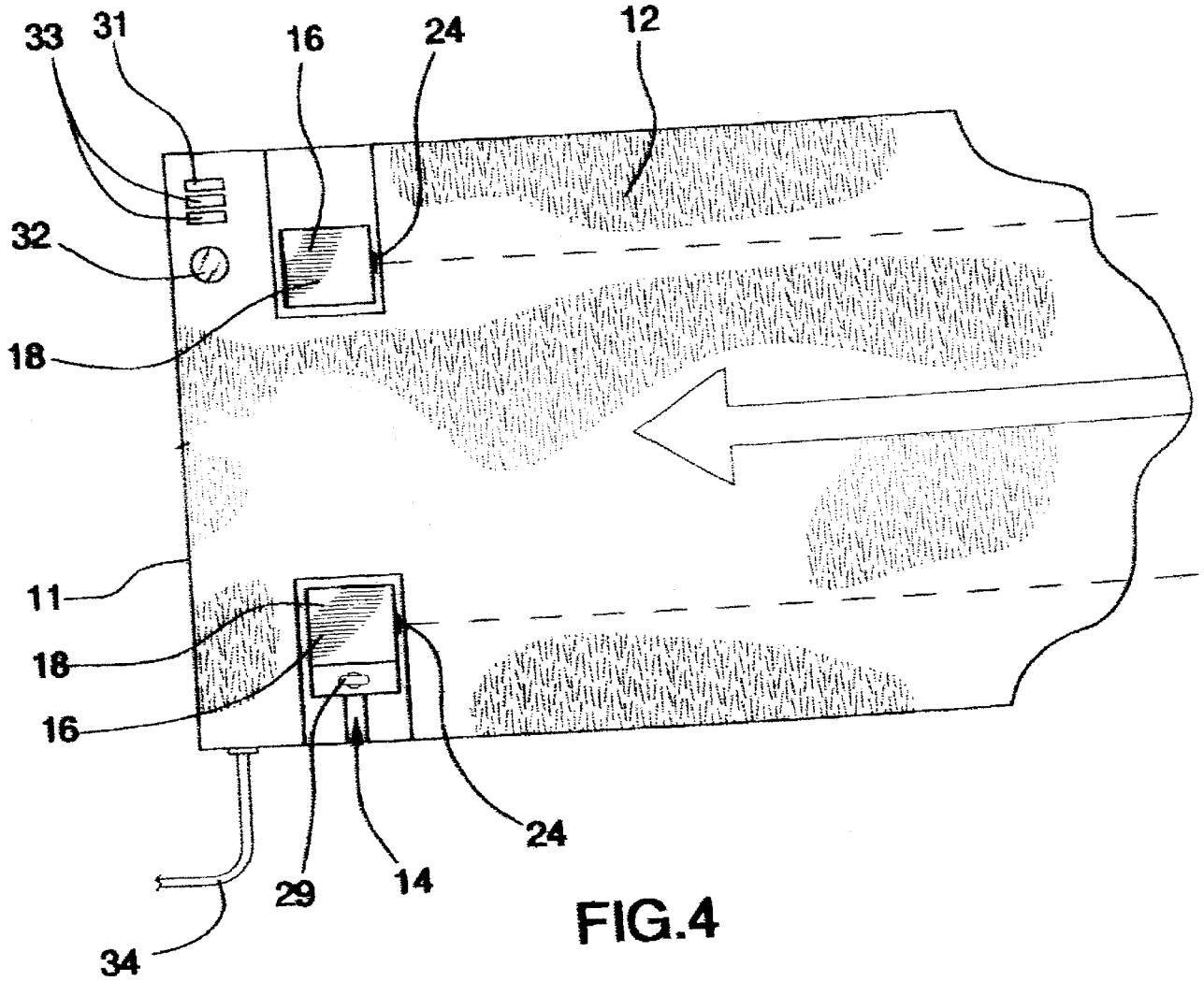
FIG. 4 is a partial top plan view of the present invention.
Figure 5:
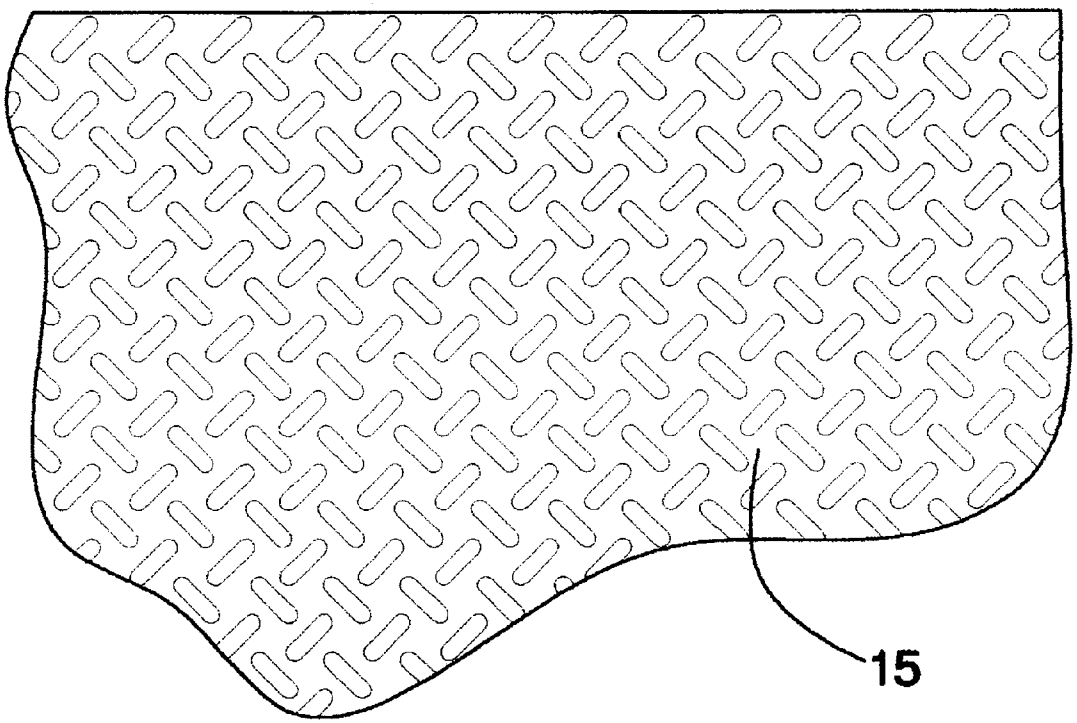
FIG. 5 is a bottom plan view of the sheet of non-slip material of the present invention.

With reference now to the drawings, and in particular to FIGS. 1 through 5 thereof, a new golf putting trainer device embodying the principles and concepts of the present invention and generally designated by the reference numeral 10 will be described.

As best illustrated in FIGS. 1 through 5, the golf putting trainer device 10 generally comprises a mat assembly including an elongate mat 11 having a top surface 12. The top surface 12 of the elongate mat 11 includes synthetic grass simulating a putting green. The elongate mat 11 also includes a laterally-viewed inverted T-shaped elongate slot 14 being disposed in a longitudinal side edge near the second end thereof. The mat assembly further includes a sheet of non-slip material 15 being conventionally attached to a bottom side of the elongate mat 11 and being made of a rubber material.

A putter miss-stroke determination assembly includes housing members 16 being disposed upon the top surface 12 of the elongate mat 11, and also includes light beam-emitting members 24 being conventionally disposed in the housing members 16, and further includes light sensor members 25 being conventionally disposed upon the top surface 12 of the elongate mat 11. Each of the housing members 16 has front, top, and bottom walls 17–19 and further has a hole 23 being disposed through the front wall 17 thereof and through which a respective light beam-emitting member directs a light beam. One of the housing members 16 also has a recessed end portion 20 being disposed in the top wall 18; and further has a rail 21 being integrally disposed upon the bottom wall 19 and being movably disposed in the laterally-viewed inverted T-shaped elongate slot 14; and also has a bore 22 being laterally disposed through the recessed end portion 20 thereof. The putter miss-stroke determination assembly further includes a fastening member being adjustably disposed in the laterally-viewed inverted T-shaped slot 14 for adjustably fastening the housing member 16 upon the elongate mat 11. The fastening member includes a washer 26 being disposed in the laterally-viewed inverted T-shaped slot 14; and also includes a threaded bolt 27 having a threaded shaft portion 28 being threaded through the washer 26, and also having a head portion 29 and a collar portion 30 being engageable to the top surface 12 of the elongate mat 11 to securely and adjustably fasten the housing member 16 to the elongate mat 11.

A putter miss-stroke signal assembly includes a sound-producing member 31 being conventionally disposed in the elongate mat 11 and being conventionally connected to the light sensor members 25 and being conventionally connected toga power cord 34 for the energizing thereof, and also includes a light-emitting member 32 being conventionally disposed in the elongate mat 11 and being conventionally connected to the light sensor members 25 and to the power cord 34. The putter miss-stroke signal assembly further includes a speaker 33 being conventionally disposed in the top surface 12 of the elongate mat 11 and being conventionally connected to the, sound-producing member 31. The light-emitting member 32 is conventionally disposed in the top surface 12 of the elongate mat 11 and is capable of flashing upon interruption of any of the beams of light by a putter.

In use, the user adjusts the positioning of one of the housing members 16 upon the elongate-mat 11 and energizes the light beam-emitting members 24 and the sound-producing member 31 and the light-emitting member 32, and the light sensor members 25. The user then places a golf ball on the top surface 12 of the elongate mat 11, and strokes the golf ball with a putter. If the putter while stroking the golf ball comes into contact with any one of the beams of light, the light-emitting member 32 would flash and the sound-producing member 31 would be actuated and an alarm sound would be sounded through the speaker 33. The user would continue to practice one's putting until one's putting stroke is perfected without coming into contact with any one of the beams of light being directed longitudinally along the elongate mat 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the golf putting trainer device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf putting trainer device comprising:

a mat assembly including an elongate mat having a top surface;

a putter miss-stroke determination assembly including housing members being disposed upon said top surface of the elongate mat, and also including light beam-emitting members being disposed in said housing members, and further including light sensor members being disposed upon said top surface of said elongate mat; and a putter miss-stroke signal assembly including a sound-producing member being disposed in said elongate mat and being connected to said light sensor members and being connected to a power cord for the energizing thereof, and also including a light-emitting member being disposed in said elongate mat and being connected to said light sensor members and to said power cord.

2. The golf putting trainer device as described in claim 1, wherein said top surface of said elongate mat includes synthetic grass simulating a putting green.

3. The golf putting trainer device as described in claim 2, wherein said elongate mat also includes a laterally-viewed inverted T-shaped elongate slot being disposed in a longitudinal side edge near said second end thereof.

4. The golf putting trainer device as described in claim 3, wherein said mat assembly further includes a sheet of non-slip material being attached to a bottom side of said elongate mat and being made of a rubber material.

5. The golf putting trainer device as described in claim 4, wherein each of said housing members has front, top, and bottom walls, and also has a hole being disposed through said front wall thereof and through which a respective said light beam-emitting member directs a light beam; one of said housing members also having a recessed end portion disposed in said top wall, and further having a rail being disposed upon said bottom wall and being movably disposed in a respective said laterally-viewed inverted T-shaped elongate slot, and also having a bore being laterally disposed through said recessed end portion thereof.

6. The golf putting trainer device as described in claim 5; wherein said putter miss-stroke determination assembly further includes a fastening member being adjustably disposed in said laterally-viewed inverted T-shaped slot for adjustably fastening said housing member upon said elongate mat.

7. The golf putting trainer device as described in claim 6, wherein said fastening member includes a washer being disposed in said laterally-viewed inverted T-shaped slot; and also includes a threaded bolt having a threaded shaft portion being threaded through said washer, and also having a head portion and a collar portion being engagable to said top surface of said elongate mat to securely and adjustably fasten said housing member to said elongate mat.

8. The golf putting trainer device as described in claim 7, wherein said putter miss-stroke signaling assembly further includes a speaker being disposed in said top surface of said elongate mat and being connected to said sound-producing member, said light-emitting member being disposed in said top surface of said elongate mat and being capable of flashing upon interruption of any of the beams of light by a putter.

* * * * *